US006641681B1

(12) United States Patent
Sandberg et al.

(10) Patent No.: US 6,641,681 B1
(45) Date of Patent: Nov. 4, 2003

(54) STEEL MATERIAL AND ITS MANUFACTURE

(75) Inventors: Odd Sandberg, Uddeholm (SE); Bo Rydell, Eskilstuna (SE)

(73) Assignee: Uddeholm Tooling Aktiebolag, Hagfors (SE)

( * ) Notice: Subject to any disclaimer, the term of this patent is extended or adjusted under 35 U.S.C. 154(b) by 0 days.

(21) Appl. No.: 10/049,432

(22) PCT Filed: Sep. 27, 2000

(86) PCT No.: PCT/SE00/01868

§ 371 (c)(1),
(2), (4) Date: Feb. 12, 2002

(87) PCT Pub. No.: WO01/25499

PCT Pub. Date: Apr. 12, 2001

(30) Foreign Application Priority Data

Oct. 5, 1999 (SE) ..... 9903580

(51) Int. Cl.[7] ..... C22C 38/22; C22C 38/24; C22C 38/26; C21D 8/00

(52) U.S. Cl. ..... 148/328; 148/334; 148/547; 148/651; 148/648

(58) Field of Search ..... 420/101; 148/328, 148/334, 547, 651, 648

(56) References Cited

U.S. PATENT DOCUMENTS 6,180,266 B1 * 1/2001 Amano et al. ..... 148/333

6,200,528 B1 * 3/2001 Rodney et al. ..... 420/101

FOREIGN PATENT DOCUMENTS

| | | |
|---|---|---|
| EP | 0 630 984 A1 | 12/1994 |
| JP | 3-134136 | 6/1991 |

OTHER PUBLICATIONS

Abstract of JP 3–134136.

* cited by examiner

*Primary Examiner*—Deborah Yee
(74) *Attorney, Agent, or Firm*—Nixon & Vanderhye

(57) ABSTRACT

The invention concerns a steel material which consists of a steel having the following chemical composition in weigh-%: 1.0–1.9 C, 0.5–2.0 Si, 0.1–1.5 Mn, 4.0–5.5 Cr, 2.5–4.0 (Mo+W/2), however max 1.0 W, 2.0–4.5 (V+Nb/2), however max 1.0. Nb, balance iron and impurities in normal amounts in the form of residual elements from the manufacturing of the steel, and with a microstructure, which in the hardened and tempered condition of the steel contains 5–12 vol-% MC-carbides, at least about 80 vol-% of the carbides having a size which is larger than 3 $\mu$m but smaller than 25 $\mu$m preferably smaller than 20 $\mu$m, and, prior to tempering, 0.50–0.70 weight-% carbon, which is dissolved in the martensite in the hardened condition of the steel. The material is intended for cold work tools, in the first place for homogenous rolls for cold rolling of meta, strips.

25 Claims, 6 Drawing Sheets

0 20 40 60 80 100 $\mu$m

STEEL MATERIAL AND ITS MANUFACTURE

TECHNICAL FIELD

The invention relates to a steel product of a steel material having a new chemical composition and microstructure. The invention also relates to the manufacturing of the material as well as its use.

BACKGROUND OF THE INVENTION

High demands as far as toughness and wear resistance are concerned are raised on materials which shall be used for the manufacturing of cold work tools. This generally is true e.g. for tools for cutting, punching, bending, and deep drawing of metal plates or sheets; tools for pressing metal powders; and cold rolling rolls. A steel which today is used for cold rolling rolls, e.g. for cold rolling of steel strips, has the nominal composition 0.73 C, 1.0 Si, 0.60 Mn, 5.25 Cr, 1.10 Mo, 0.50 V, balance iron and unavoidable impurities. Rolls made of that material normally has a hardness of 58–60 HRC in the use condition, when the roll is through hardened. It is a problem with this material that the material has a tendency to crack in the through hardened condition of the material, which may cause a total failure. Moreover, the wear resistance is not quite satisfactory. Powder metallurgy manufactured steels on the other hand, which contain high contents of vanadium, satisfy high demands as far as toughness as well as wear resistance are concerned, but are expensive. It is conventional to design cold rolling rolls made of compound materials, wherein a wear resistant outer material, which usually consists of a high alloyed steel, is united through casting or in any other mode with a core made of a tougher material, which usually is less alloyed In this way it is possible to obtain a roll with good wear resistance and toughness. On among several disadvantages is that the manufacturing is expensive. Therefore it exists a demand of materials which do not require powder metallurgy manufacture or compounding technique but which nevertheless satisfy the demands which are raised on cold work steels, among them toughness and wear resistance.

BRIEF DISCLOSURE OF THE INVENTION

The purpose of the invention is to address the above problems and provide a new steel material which can be employed for cold work tools, particularly for cold rolling rolls, and which has a satisfactory toughness, hardenability, and wear resistance. In the first place the invention aims at providing a material for solid working rolls and/or for supporting rolls for cold rolling of steel strips. "Solid" is this context means rolls which do not consist of compound materials. This and other objectives of the invention can be achieved by a chemical composition, which is a characterising feature of the invention, in combination with a microstructure of the steel which also is a characterising feature.

The chemical composition and the microstructure of the steel of the invention are stated in the appending patent claims and will be commented more in detail in the following. If not otherwise is mentioned, always weight-% are referred to.

The structure of the steel product of the invention has a hardness in the order of 250 HB in the soft annealed condition and a hardness of 30–50 HRC in the tough hardened condition, and a microstructure which contains 5–12 vol-% MC-carbides, at least about 50 vol-%, preferably at least about 80 vol-%, having a size which is larger than 3 μm but smaller than 25 μm, preferably smaller than 20 μm. Preferably at least 90 vol-% of the precipitated carbides of MC-type have a size which is larger than 3 μm but smaller than 25 μm, preferably smaller than 20 μm. This material is suited to be subjected to cutting type of work in connection with the manufacturing of the tool. In the condition of use the finished product, i.e. the tool, e.g. the roll, has a surface hardness amounting to 60–67 HRC, which can be afforded by through hardening or induction hardening followed by tempering, wherein the microstructure in the hardened and tempered material consists of tempered martensite containing 5–12 vol-% MC-carbides, of which at least 50 vol-%, preferably at least about 80 vol-% have a size which is larger than 3 μm but smaller than 25 μm, preferably smaller than 20 μm. Preferably also in this case at least about 90 vol-% of the MC-carbides have a size which is larger than 3 μm but smaller than 25 μm, preferably smaller than 20 μm. Prior to tempering, the martensite contains 0.50–0.70 weight-% C. Size in this text means the longest extension of the carbide particle in any direction in a studied section of the material.

For the achievement of the said carbide dispersion in the matrix of the steel, a number of techniques which may be known per se can be employed for the production of steel ingots, from which the steel product is manufactured. In the first place the so called spray forming technique is recommended, which is also known as the OSPREY-method, according to which an ingot rotating about its longitudinal axis successively is established therein that molten metal in the form of drops is sprayed against the growing end of the ingot which continuously is being manufactured, wherein the drops are caused to solidify comparatively fast once they have hit the substrate, however not as fast as in connection with powder manufacturing and not as slow as in connection with conventional manufacturing of ingots or in connection with continuous casting. Another technique which possibly might be employed is ESR-remelting (Electro Slag Remelting), in the first place for the manufacturing of products of larger sizes, i.e. with diameters from Ø 350 mm up to 600 mm.

As far as the various alloying elements in the steel are concerned, the following applies.

Carbon shall exist in a sufficient amount in the steel in order, on one hand, together with vanadium and possibly existing niobium to form 5–12 vol-% MC-carbides, where M substantially is vanadium, and on the other hand to exist in solid solution in the matrix of the steel in an amount of 0.50–0.70 weight-%. Suitably, the content of carbon that is dissolved in the matrix of the steel is about 0.60%. The total amount of carbon in the steel, i.e. carbon that is dissolved in the matrix of the steel plus that carbon that is bound in carbides, shall be at least 1.0%, preferably at least 1.1%, while the maximum content of carbon may amount to 1.9%, preferably max 1.7%.

According to a first preferred embodiment of the invention, the steel contains 1.4–1.7 C, preferably 1.45–1.65 C, nominally about 1.5 C, in combination with 3–4.5 V, preferably 3.4–4.0 V, nominally about 3.7 V in order to provide a total content of MC-carbides amounting to 8–12, preferably 9–11 vol-% MC-carbides, in which vanadium partly can be replaced by the double amount of niobium.

According to a second preferred embodiment, the steel contains 1.1–1.3 C, nominally about 1.2 C, in combination with 2.0–3.0 V, nominally about 2.3 V in order to provide a total content of MC-carbides amounting to 5–7 vol-%, preferably about 6 vol-% MC-carbides, in which the vanadium partly can be replaced by the double amount of niobium.

According to all embodiments, the hardened, martensitic matrix of the steel contains 0.50–0.70% C prior to tempering.

Silicon, which partly can be replaced by aluminium, shall, together with possibly existing aluminium, exist in a total amount of 0.5–2.0%, preferably in a an amount of 0.7–1.5%, suitably in an amount of 0.8–1.2% or in a nominal amount of about 1.0% in order to increase the carbon activity in the steel and hence contribute to the achievement of an adequate hardness of the steel without creating brittleness problems because of dissolution hardening at too high contents of silicon. The aluminium content, however, must not exceed 1.0%. Preferably, the steel does not contain more than max 0.1% Al. Manganese, chromium, and molybdenum shall exist in the steel in a sufficient amount in order to afford the steel an adequate hardenability. Manganese also has a function to bind those residual amounts of sulphur, which can exist in low contents in the steel, by forming manganese sulphide. Manganese therefore shall exist in an amount of 0.1–1.5%, preferably in an amount of at least 0.2%. A most suitable content lies in the range 0.3–1.1%, most conveniently in the range 0.4–0.8%. The nominal content of manganese is about 0.6%.

The steel product of the invention shall be able to be hardened through induction hardening to an induction hardening depth which is deeper than 35 mm, as well as by through hardening.

Chromium, which strongly promotes the hardenability, therefore shall exist in the steel in order, together with manganese and molybdenum, to give the steel a hardenability, which is adapted to its intended use. Hardenability in this connection means the ability of the hardening to penetrate more or less deep in the object that is hardened. The hardenability shall be sufficient for the object to be through hardened even in the case of considerably large size objects without requiring very fast cooling in oil or water duning the hardening operation, which could cause dimensional changes, and for the provision of a hardness of 60–64 HRC, normally 62–64 HRC, in the cross section of the object If the object is induction hardened, higher hardnesses possibly may be achieved, about 65–67 HRC, but also as far as induction hardened objects are concerned, the hardness in the surface layer normally is 62–64 HRC. In order that the desired hardenability shall be achieved for certain, when the steel has the manganese and molybdenum contents in question, the chromium content shall amount to at least 4.0%, preferably to at least 4.4%. At the same time, the chromium must not exceed 5.5%, preferably amount to max 5.2% in order that non-desired chromium carbides shall not be formed in the steel.

Vanadium shall exist in the steel in an content of at least 2.0% and max 4.5% in order, together with carbon, to form said MC-carbides in the tough hardened, martensitic matrix of the steel. As has been mentioned in the foregoing, the steel according to the first preferred embodiment of the invention contains 3–4.5 V, preferably 3.44.0 V, nominally about 3.7 V, in combination with an adequate amount of carbon in order to provide a total amount of MC-carbides amounting to 8–12, preferably 9–11 vol-% in the hardened and tempered condition. According to the second, above mentioned, conceivable embodiment, the steel contains 2.0–3.0 V, nominally about 2–3 V, in combination with the amount of carbon which has been mentioned in the foregoing in order to provide a total content of MC-carbides amounting to 5–7 vol-%, preferably about 6 vol-%. In principle, vanadium can be replaced by niobium, but therefore there is required twice the amount of niobium as compared with vanadium, which is a drawback. Besides, niobium may cause the carbides to get a more edgy shape and they also become larger than pure vanadium carbides, which may initiate fractures or chippings and consequently reduce the toughness of the material. Therefore niobium must not exist in an amount of more than max 1.0%, preferably max 0.5%. Most advantageously the steel should not contain any intentionally added niobium, which in the most preferred embodiment of the steel therefore should not be tolerated more than as an impurity in the form of residual elements from the raw materials used for the manufacturing of the steel.

Molybdenum shall exist in an amount of at least 2.5% in order to give the steel a desired hardenability in spite of the restricted amount of manganese and chromium which is a characteristic feature of the steel. Preferably, the steel should contain at least 2.8% Mo, most conveniently at least 3.0 Mo. Maximally, the steel may contain 4.0% Mo, preferably max 3.8, suitably max 3.6% Mo in order that the steel shall not contain non-desired M6C-carbides at the expense of the desired amount of MC-carbides. Molybdenum in principle can be replaced wholly or partly by tungsten, but this requires twice as much tungsten as molybdenum, which is a drawback Also the scrap handling would be more difficult. Therefore tungsten should not exist in an amount of more than max 1.0%, preferably max 0.5%. Most conveniently, the steel should not contain any intentionally added tungsten, which in the most preferred embodiment should not be tolerated in amounts more than as an impurity in the form of residual elements from the raw materials used for the manufacturing of the steel.

The steel need not, and should not, contain any more alloying elements in significant amounts in addition to the above mentioned alloying elements. Some elements are definitely undesired, because they have an undesired influence on the features of the steel. This e.g. is the case for phosphorous which should be kept as low as possible in order not to impair the toughness of the steel. Also sulphur is an undesired element, but its negative impact on the toughness can substantially be neutralised by means of manganese, which forms essentially harmless manganese sulphides. Sulphur therefore can be tolerated in a maximum amount of 0.2%, preferably max 0.05%, and suitably max 0.02%. Other elements, such as nickel, copper, cobalt, and other may exist at impurity levels in the form of residual elements from used raw materials in connection with the manufacturing of the steel. Nitrogen is present as an unavoidable impurity in the steel but does not exist as an intentionally added element.

Further characteristic features and aspects of the invention will be apparent from the following description of performed experiments and from the appending patent claims.

BRIEF DESCRIPTION OF DRAWINGS

In the following description of performed experiments, reference will be made to the accompanying drawings, in which.

DESCRIPTION OF PERFORMED EXPERIMENTS

Eight 50 kg laboratory heats were produced. The compositions of the steel, weight-% for the alloying elements and vol-% for the carbide content, are given in Table 1. The heats were forged to the shape of bars of size 60×60 mm.

TABLE 1

Composition of experimental alloys, weight-%

| Steel No | TA ° C. | C | Si | Mn | P | S | Cr | Co | V | N | C* | MC vol-% | M3C vol-% | Total carbide content vol-% |
|---|---|---|---|---|---|---|---|---|---|---|---|---|---|---|
| 1 | 980 | 0.72 | 0.74 | 0.60 | 0.005 | 0.005 | 5.43 | 1.16 | 0.52 | 0.02 | 0.58 | 0.9 | 0.9 | 1.8 |
| 2 | 980 | 1.10 | 0.82 | 0.66 | 0.008 | 0.007 | 5.54 | 1.17 | 2.00 | 0.02 | 0.58 | 4.6 | 1.1 | 5.7 |
| 3 | 1020 | 1.35 | 0.76 | 0.68 | 0.009 | 0.007 | 5.50 | 1.18 | 2.6 | 0.03 | 0.80 | 4.6 | 1.9 | 6.5 |
| 4 | 1020 | 1.34 | 0.70 | 0.62 | 0.009 | 0.006 | 8.20 | 1.58 | 1.93 | 0.03 | 0.59 | 3.6 | 6.3 | 9.9 |
| 5 | 1030 | 1.44 | 1.15 | 0.66 | 0.012 | 0.005 | 4.58 | 2.86 | 3.62 | 0.03 | 0.54 | 9.0 | 0 | 9.0 |
| 6 | 1030 | 1.51 | 1.20 | 0.67 | 0.014 | 0.006 | 4.59 | 3.50 | 3.62 | 0.05 | 0.57 | 9.5 | 0 | 9.5 |
| 7 | 1030 | 1.57 | 1.02 | 0.66 | 0.017 | 0.006 | 5.01 | 3.52 | 3.99 | 0.05 | 0.55 | 10.2 | 0 | 10.2 |
| 8 | 1030 | 1.15 | 1.12 | 0.64 | 0.010 | 0.005 | 4.46 | 2.80 | 2.12 | 0.02 | 0.61 | 5.5 | 0 | 5.5 |

*calculated content of carbon dissolved in the matrix of the tempered martensite.

In Table 1, steel Nos. 1–4 are reference materials, while the steels Nos 5–8 have compositions according to the invention More particularly, steels Nos. 5, 6, and 7 are examples of compositions according to said first preferred embodiment of the steel, while steel No. 8 is an example of the said, second conceivable embodiment of the steel of the invention. The manufactured experimental alloys were examined with reference to hardness (HB) after soft annealing, microstructure after heat treatment; TA=1030° C./30 min/air+525° C./2×2 h, hardness after autenitising at TA=1030° C./30 min/air+525° C./2×2 h, hardness after tempering at 200° C., 300° C., 400° C., 500° C., 525°, 600° C./2×2 h, TA=1030C/30 min/air, hardenability, resistance to abrasive wear, toughness

SOFT ANNEALED TOUGHNESS

The soft annealed toughness of steel alloys Nos. 1 and 4–8 is shown in Table 2. The hardness can be regarded as normal in view of the carbide and vanadium content of the alloys.

TABLE 2

Soft annealed hardness

| Steel No. | Hardness (HB) |
|---|---|
| 1 | 224 |
| 4 | 223 |
| 5 | 249 |
| 6 | 257 |
| 7 | 259 |
| 8 | 241 |

MICROSTRUCTURE

The microstructure after a heat treatment consisting of autenitising at 980–1030° C./30 min+tempering at 500–525° C./2×2 h was examined by light-optical microscope studies and through Thermo-Calc calculations of the various alloy variants. The amount of carbides was increased with an elevated content of chromium and vanadium. Steel No. 4 and No. 7 had the largest amount of carbide phase, see Table 1.

HARDNESS VERSUS TEMPERING TEMPERATURE

Figure 1:
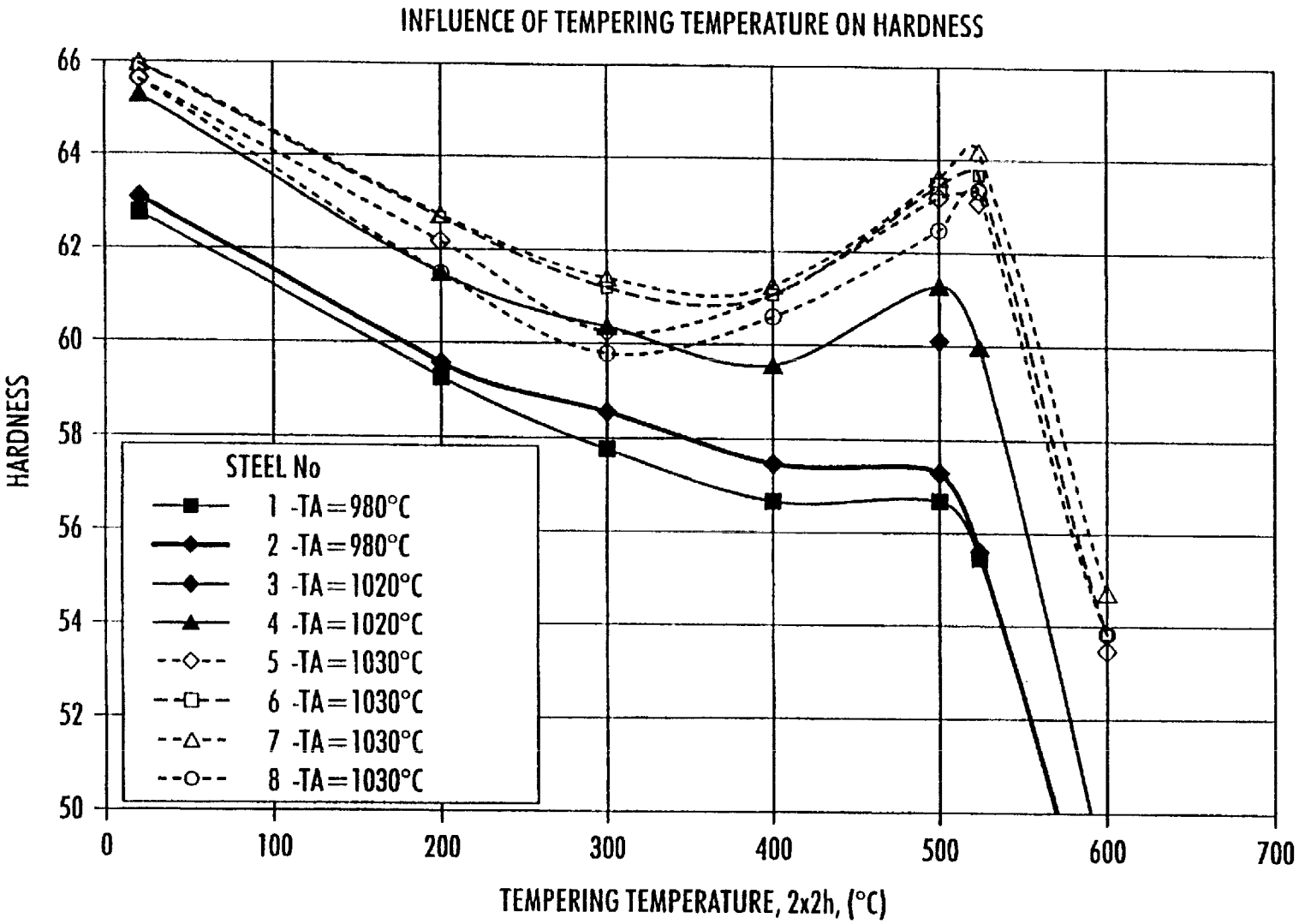
FIG. 1 is a diagram which shows the influence of the tempering temperature on the hardness of the examined steels.
Figure 2:
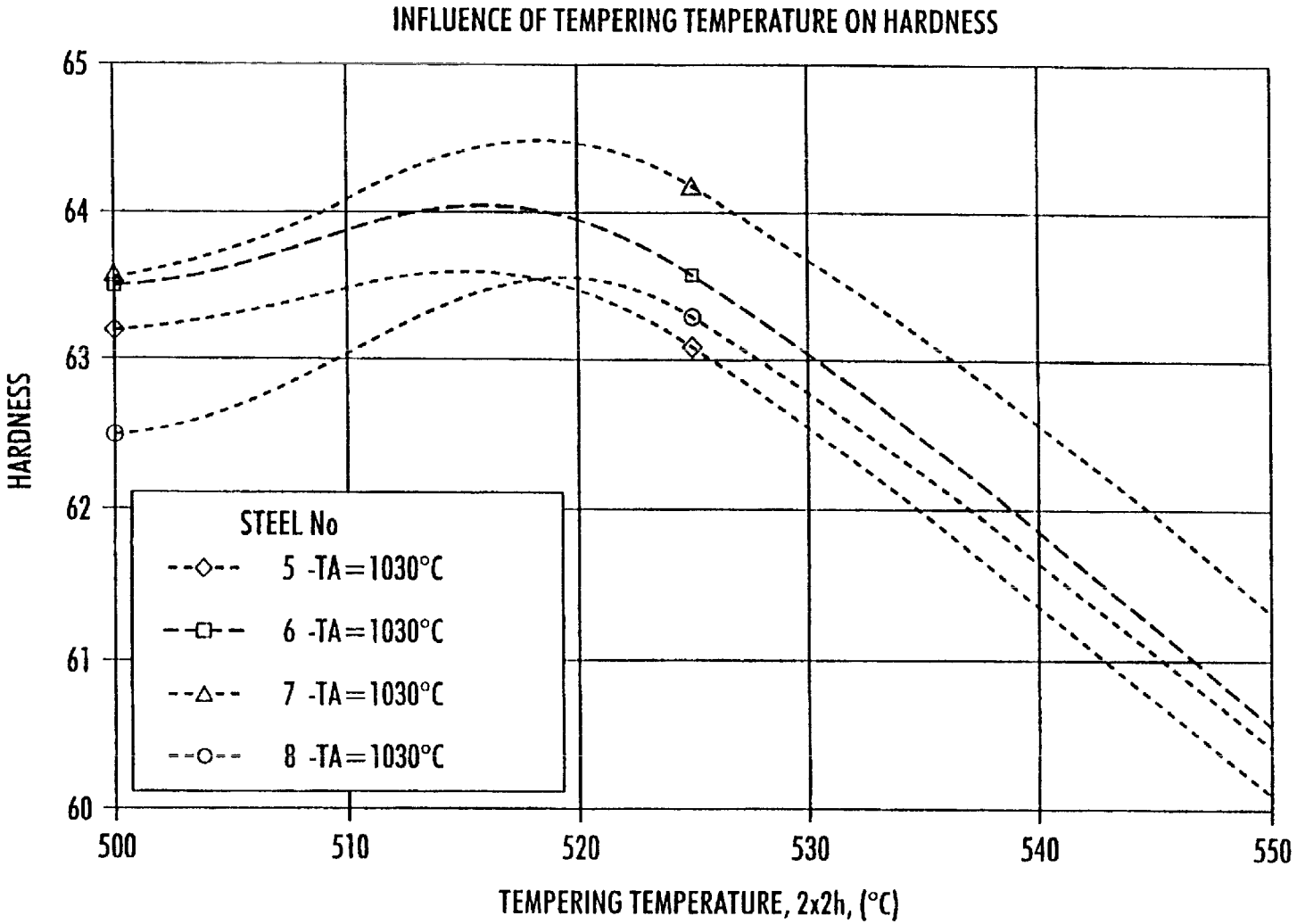
FIG. 2 shows, at a larger scale, the peak region of the tempering curves in FIG. 1 of those steels which have the highest hardness values.

The influence of the tempering temperature on the hardness of the examined steels, which were austenitised at a number of different austenitising temperatures, is shown in the diagrams in FIG. 1 and FIG. 2. The requirement of a hardness of at least 60 HRC after tempering was achieved by a comfortable margin as far as all the steel variants of the invention are concerned after autenitising at 1030° C./30 min and tempering at 525–550° C./2×2 h.

HARDENABILITY

The hardenability of the steels was measured through comparative dilatometer measurements. The measured hardness values are stated in Table 3.

TABLE 3

Hardness as measured in dilatometer tests

| Steel No | Hardness (HV 10) |
|---|---|
| 1 | 542 |
| 4 | 572 |
| 5 | 592 |

TABLE 3-continued

| Hardness as measured in dilatometer tests | |
|---|---|
| Steel No | Hardness (HV 10) |
| 6 | 599 |
| 7 | 627 |
| 8 | 572 |

As compared with steel No. 1, the other alloys had an improved hardenability. Particularly, steel No. 6, which has a higher Mo content, had an improved hardenability.

TOUGHNESS

Figure 3:
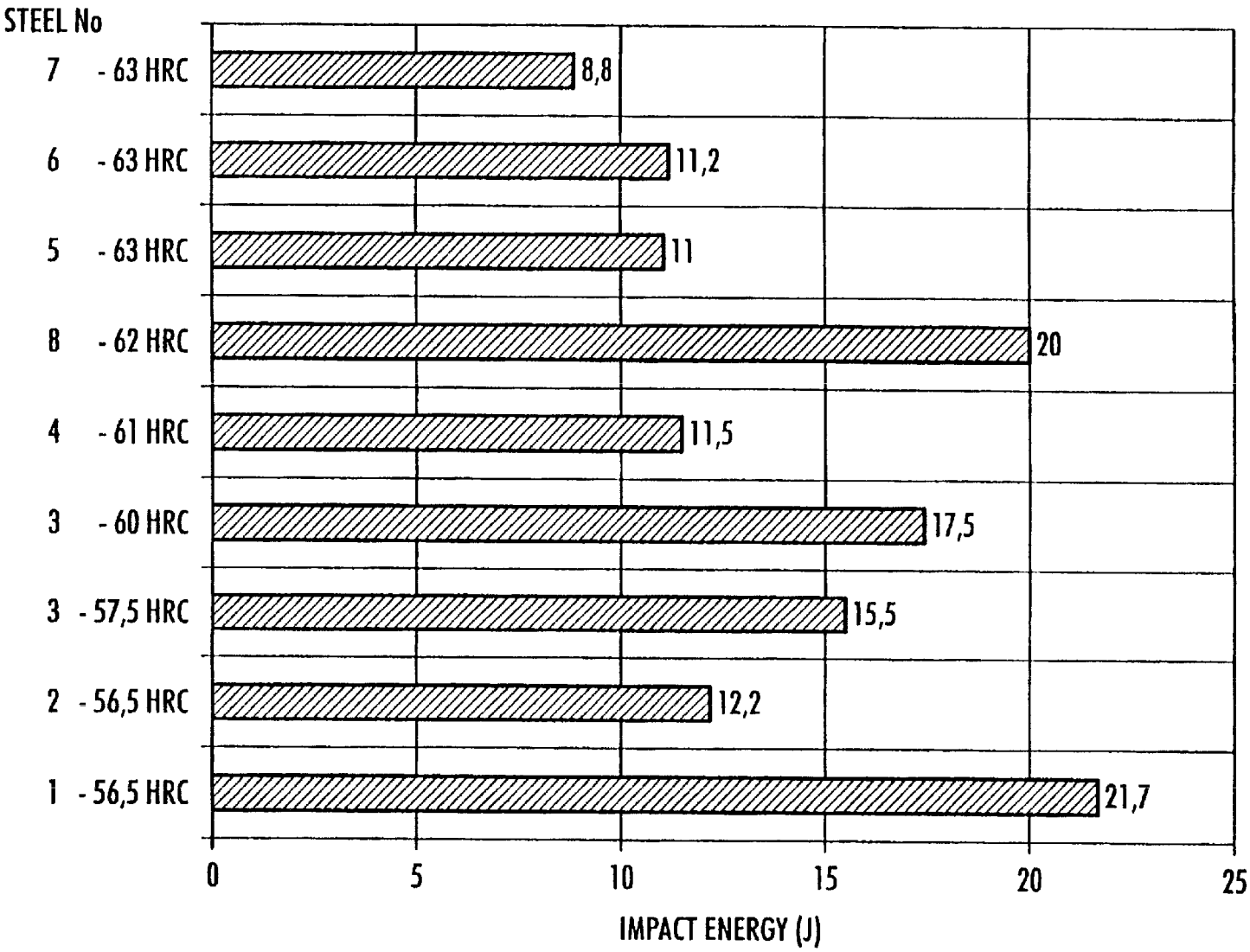
FIG. 3 is a bar chart showing the toughness of the examined steels versus the impact energy.

The results of impact tests at room temperature with un-notched test specimens of the examined steels are stated in FIG. 3. The toughness was decreased as the carbide content was increased. However, particularly steel No. 8 had a very good toughness in view of the fact that the hardness is as high as 62 HRC as compared with 56.5 HRC for steel No. 1.

ABRASIVE WEAR

Figure 4:
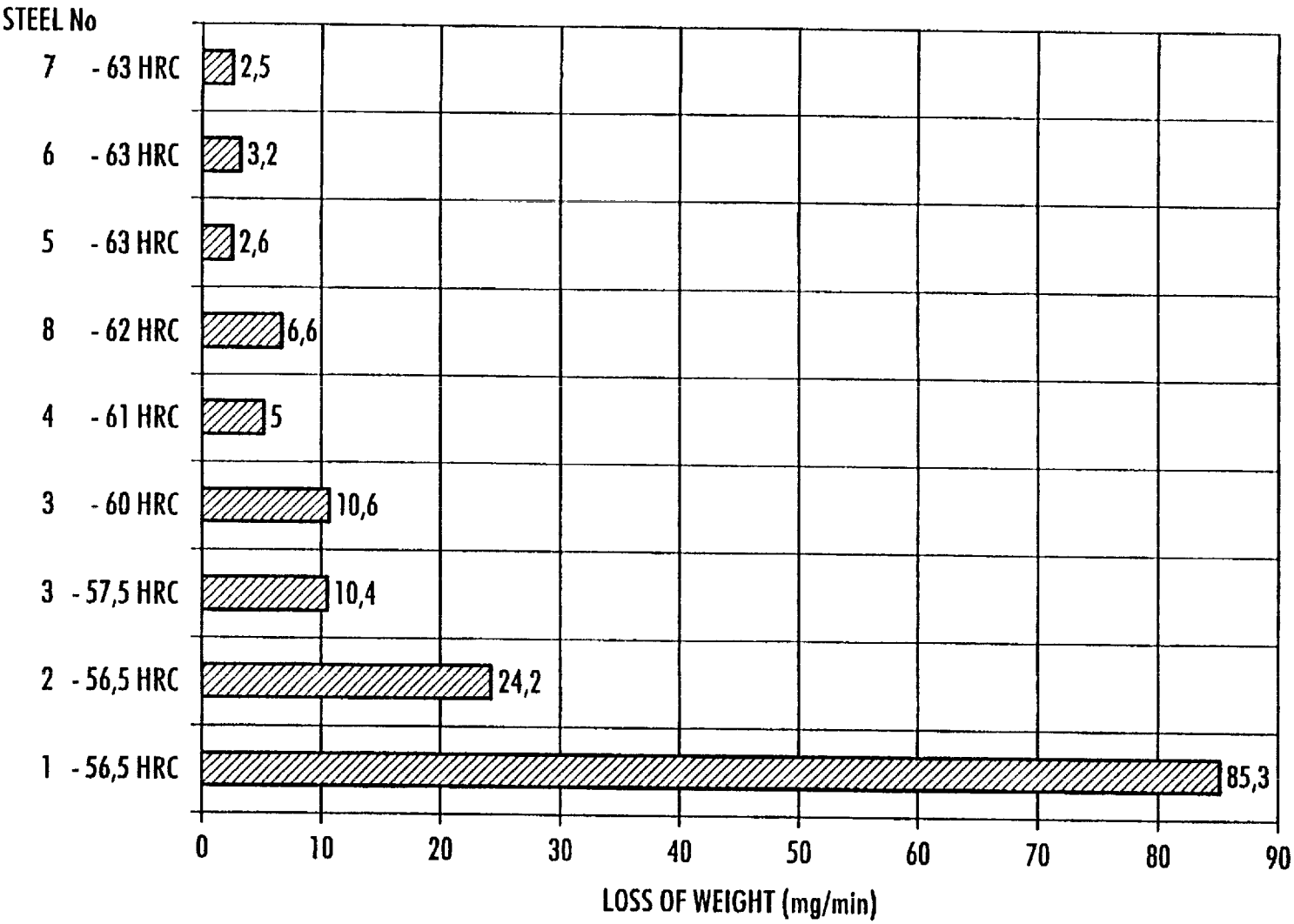
FIG. 4 is a bar chart which shows the abrasive wear resistance of the examined steels.

The wear resistance was examined via pin-to-disc-test with $SiO_2$ as an abrasive agent. The wear resistance was strongly increased with an increased content of vanadium, as is illustrated in FIG. 4.

DISCUSSION—FEATURE PROFILE

Table 1 shows the content of carbon, MC (vanadium carbide), $M_3C$ (cementite), and total carbide content at a number of different autenitising temperatures, where an equilibrium is believed to exist for the different alloys.

Figure 5:
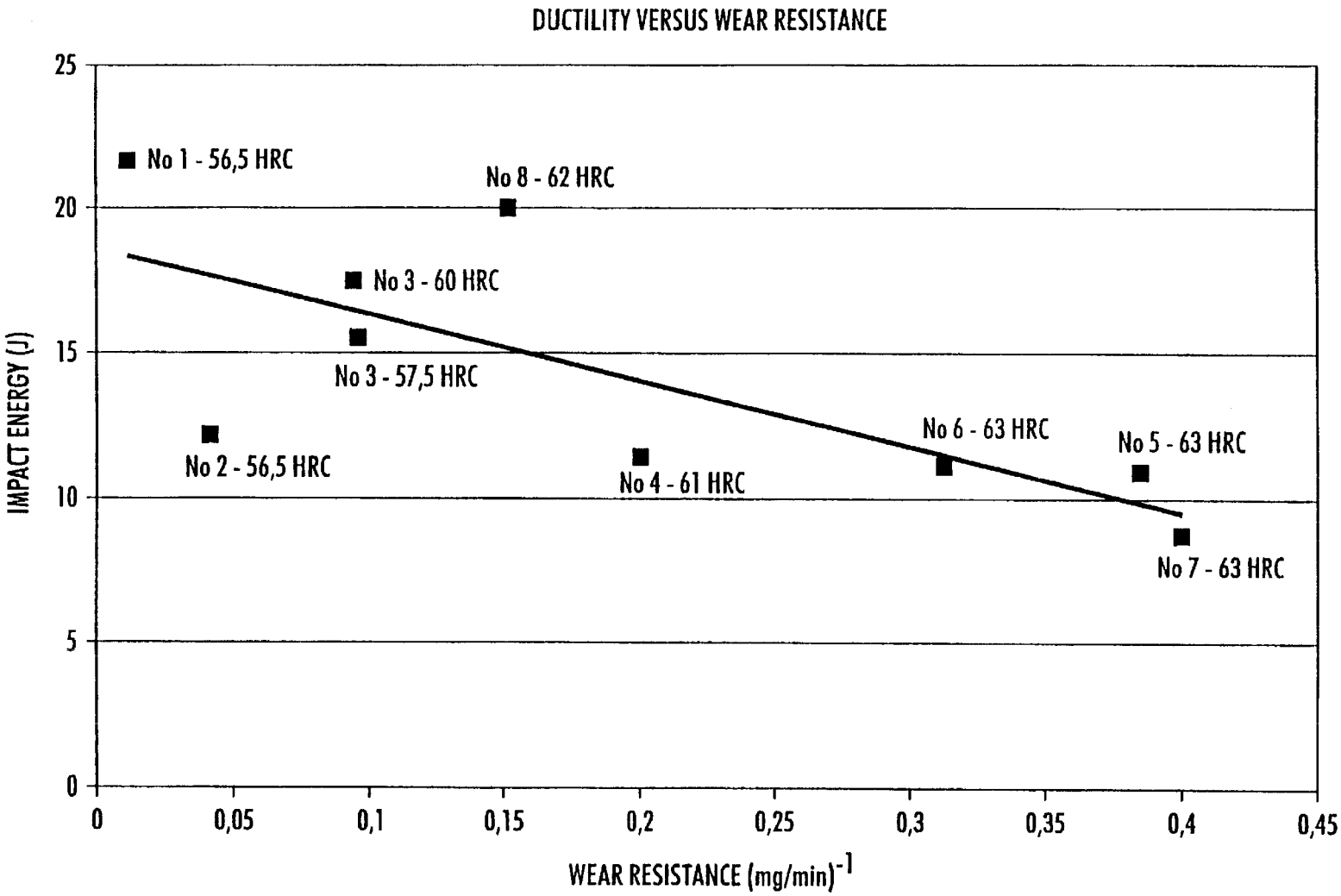
FIG. 5 is a diagram which illustrates the ductility, measured through impact tests with un-notched specimens, versus the wear resistance of the examined steels.

FIG. 5 illustrates the relation between ductility as measured through impact tests with un-notched test specimens and the wear resistance, pin-to-disc-test with $SiO_2$ of the examined alloys.

On the basis of the experiences derived from the above described experiments it was believed that the nominal compositions of the two said embodiments of the steel of the invention should have the compositions according to Table 4, in which the chemical compositions are expressed in weight-% and the carbide content in the hardened and tempered condition is expressed in vol-%, balance iron and unavoidable impurities in said amounts. C refers to the amount of carbon dissolved in the martensite.

TABLE 4

| Conceivable nominal compositions, weight-%; vol-% | | | | | | | | | | | |
|---|---|---|---|---|---|---|---|---|---|---|---|
| Steel alloy | C | Si | Mn | P | S | Cr | Mo | V | N | C | MC % |
| Type I | 1.22 | 1.0 | 0.6 | 0.01 | 0.001 | 4.6 | 2.8 | 2.3 | 0.01 | 0.64 | 5.9 |
| Type II | 1.51 | 1.0 | 0.6 | 0.01 | 0.001 | 4.6 | 3.2 | 3.7 | 0.01 | 0.57 | 9.4 |

On the basis of the experiences from the studies of the materials which were produced at a laboratory scale, then two full scale heats were manufactured through the spray forming technique. Each heat had the weight 2300 kg and the diameter 500 mm. The chemical compositions of the steels are given in Table 5.

TABLE 5

| Chemical composition, weight-%, of materials produced through spray forming | | | | | | | | | |
|---|---|---|---|---|---|---|---|---|---|
| Steel heat No. | C | Si | Mn | P | S | Cr | Mo | V | N |
| 122 | 1.36 | 0.67 | 0.58 | 0.017 | 0.011 | 4.60 | 2.90 | 2.60 | 0.046 |
| 126 | 1.50 | 1.00 | 0.59 | 0.020 | 0.017 | 4.62 | 3.40 | 4.0 | 0.04 |

These heats were forged at the temperature 1130° C. to the shape of bars of final size Ø 250 mm. From these bars, there were taken test specimens, the microstructures of which were examined. These studies showed that the carbides adjacent to the surface of the bars were smaller than in the central parts of the bars, which is a natural consequence of the cooling rate of the heats. In the surface, the majority of the carbides thus could be smaller than 3 $\mu$m, but through studies of a plurality of samples taken at different depths over the cross sections of the bars, it could be stated that the size in the main part of the bars satisfied the requirements that at least 50 vol-%, and as a matter of fact at least 80 vol-% of the carbides had sizes within the size range 3–25 $\mu$m normally within the range 3–20 $\mu$m prior to heat treatment of the bars as well as after hardening and tempering.

Figure 6:
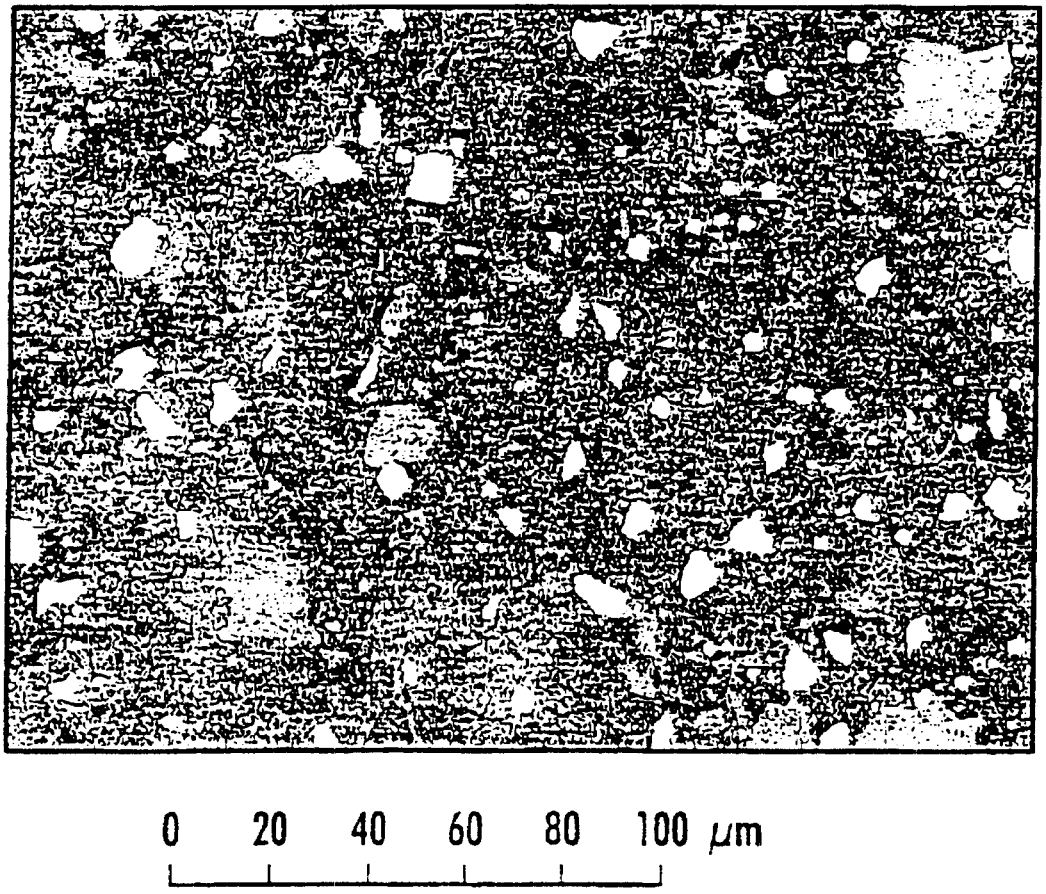
FIG. 6 shows the microstructure of a steel material according to the invention in a studied section of the material.

FIG. 6 shows the microstructure prior to hardening and tempering of a sample which has been taken in the centre of a bar which was made from steel heat No. 126.

What is claimed is:

1. Steel material, which consists of a steel having the following chemical composition in weight-%: 1.0–1.9 C, 0.5–2.0 Si, 0.1–1.5 Mn, 4.0–5.2 Cr, 2.5–4.0

$$\left(Mo + \frac{W}{2}\right),$$

however max 1.0 W 2.0–4.5

$$\left(V + \frac{Nb}{2}\right),$$

however max 1.0 Nb, balance iron and impurities in normal amounts in the form of residual elements from the manufacturing of the steel, and with a microstructure, which in the hardened and tempered condition of the steel contains 5–12 vol-% MC-carbides, of which at least 50 vol-% has a size which is larger than 3 $\mu$m but smaller than 25 $\mu$m, and, prior to tempering, 0.50–0.70 weight-% carbon, which is dissolved in the martensite in the hardened condition of the steel.

2. Steel material according to claim 1, wherein it contains 1.35–1.7 C and 3.0–4.5 V.

3. Steel material according to claim 2, wherein contains 1.40–1.65 C, and 3.4–4.0 V, and a total content of MC-carbides amounting to 8–12 vol-%.

4. Steel material according to claim 1, wherein it contains 1.1–1.3 C and 2.0–3.0 V in order to provide a total content of MC-carbides amounting to 5–7 vol-%.

5. Steel material according to claim 1, wherein the steel contains 0.7–1.5% Si.

6. Steel material according to claim 1, wherein the silicon partly is replaced by aluminium, however, the steel not containing more than 1.0% aluminium.

7. Steel material according to claim 1, wherein the steel contains 0.2% Mn.

8. Steel material according to claim 1, wherein it contains 4.4–5.2% Cr.

9. Steel material according to claim 1, wherein the steel contains 2.5–3.6 Mo % Mo.

10. Method for the manufacturing of a steel product, comprising preparing a steel melt having a chemical composition in weight-% according to claim 1, manufacturing an ingot from this melt through spray forming, working the ingot to a desired final shape through plastic working and/or machining, heat-treating the thus obtained product through austenitising at 1000–1100° C. and tempering at 500–600° C. for the achievement of a matrix consisting of tempered martensite and in the matrix 5–12 vol-% MC-carbides, at least 50 vol-%, of the carbides having a size which is larger than 3 $\mu$m but smaller than 25 $\mu$m.

11. Steel product, wherein it is manufactured according to the method according to claim 10, and wherein the matrix of the steel contains 8–12 vol-% MC-carbides and wherein the martensite after hardening contains 0.50–0.70 weight-% dissolved carbon.

12. Steel product, wherein it is manufactured according to the method according to claim 10 and wherein the matrix of the steel after hardening consists of martensite, which contains 5–7 vol-% MC-carbides and 0.50–0.70 weight-% dissolved carbon.

13. Steel material according to claim 1, wherein at least about 80 vol-% of the MC-carbides has a size which is larger than 3 $\mu$m but smaller than 25 $\mu$m.

14. Steel material according to claim 13, wherein at least 50 vol-% of the MC-carbides has a size which is larger than 3 $\mu$m but smaller than 20 $\mu$m.

15. Steel material according to claim 14, wherein at least about 80 vol-% of the MC-carbides has a size which is larger than 3 $\mu$m but smaller than 20 $\mu$m.

16. Steel material according to claim 2, wherein it contains at least 1.45% C and a total content of MC-carbides amounting to 9–11 vol-%.

17. Steel material according to claim 5, wherein the steel contains 0.8–1.2% Si.

18. Steel material according to claim 6, wherein the steel does not contain more than max 0.1 aluminium.

19. Steel material according to claim 7, wherein the steel contains 0.3–1.1% Mn.

20. Steel material according to claim 19, wherein the steel contains 0.4–0.8 Mn.

21. Steel material according to claim 9, wherein the steel contains 2.75–3.25% Mo.

22. Method according to claim 10, wherein the obtained product is heat treated for the achievement of a matrix in which at least about 80 vol-% of the MC-carbides have a size which is larger than 3 $\mu$m but smaller than 25 $\mu$m.

23. Method according to claim 22, wherein the obtained product is heat treated for the achievement of a matrix in which at least 50 vol-% of the MC-carbides have a size which is larger than 3 $\mu$m but smaller than 20 $\mu$m.

24. Method according to claim 23, wherein the obtained product is heat treated for the achievement of a matrix in which at least about 80 vol-% of the MC-carbides have a size which is larger than 3 $\mu$m but smaller than 20 $\mu$m.

25. Steel product according to claim 11, wherein the matrix of the steel contains 9–11 vol-% MC-carbides.

* * * * *